US005806771A

United States Patent [19]

Loschelder et al.

[11] Patent Number: 5,806,771

[45] Date of Patent: Sep. 15, 1998

[54] KITCHEN FAUCET SIDE SPRAY

[75] Inventors: Todd C. Loschelder, Macedonia; Witold Bauer, Westlake; Eduardo E. Milrud, Chagrin Falls; Lonnie F. Cool, La Grange; Thomas J. Overberg, North Olmsted, all of Ohio

[73] Assignee: Moen Incorporated, North Olmsted, Ohio

[21] Appl. No.: 786,639

[22] Filed: Jan. 21, 1997

[51] Int. Cl.[6] ..... A62C 31/00

[52] U.S. Cl. ..... 239/446; 239/526

[58] Field of Search ..... 239/443, 444, 239/446, 447, 449, 525, 526

[56] References Cited

U.S. PATENT DOCUMENTS

| | | | |
|---|---|---|---|
| 2,567,176 | 9/1951 | Ballard | 239/526 X |
| 4,396,156 | 8/1983 | Southworth et al. | 239/526 |
| 4,629,124 | 12/1986 | Gruber . | |
| 4,703,893 | 11/1987 | Gruber . | |
| 5,100,055 | 3/1992 | Rokitenetz et al. | 239/443 X |
| 5,145,114 | 9/1992 | Monch . | |
| 5,158,234 | 10/1992 | Magnenat et al. . | |
| 5,184,777 | 2/1993 | Magnenat et al. . | |
| 5,323,968 | 6/1994 | Kingston et al. . | |
| 5,348,231 | 9/1994 | Arnold et al. . | |
| 5,383,604 | 1/1995 | Boesch . | |

*Primary Examiner*—Andres Kashnikow
*Assistant Examiner*—Steven J. Ganey
*Attorney, Agent, or Firm*—Dorn, McEachran, Jambor & Keating

[57] ABSTRACT

A spray device for use as an alternate water discharge to a faucet has a body with a handle and a spray head. The spray head has a first central water discharge in the form of a localized stream and a second peripheral spray type water discharge. There is a trigger which is movable on the body between an inoperable position, a first operable position, and a second operable position. In the first operable position water passes through the spray head central discharge and in the second operable position water passes through the peripheral spray. There is a chamber within the body which communicates with the first and second water discharges and there is a water passage in the handle communicating with the chamber. A piston is movable within the chamber and there is a water passage within the piston which may connect to the handle water passage. A stem is positioned within the chamber and is connected to and movable with the piston. The stem has a seal for closing the piston water passage. A coaxial spring biases the stem seal toward a piston water passage closing position. A flow diverter is located adjacent both water discharge passages, with the flow diverter being movable by the piston between positions in which water flows from the piston water passage to either of the first or second water discharges.

20 Claims, 4 Drawing Sheets

10
38
14
116
36
28
12
24
30
22
90
46
78
62
48
56
32
50
26
34
104
64
16
-18-
20

68
10
66
26
58
68
116
14
16
10
14
68
58
46
26
47
66
116
64
16

26
38
36
12
72
82
90
80
88
65
84
46
22
24
50
112
78
64
16

38
106
36
108
92
72
82
92
98
118
112
78
48
50
22
64
16

40
24
48
9
44
42
24
9

40
44
48

KITCHEN FAUCET SIDE SPRAY

THE FIELD OF THE INVENTION

The present invention relates to a side spray of the type commonly used with a kitchen faucet. Normally, such a spray will be mounted on the end of a flexible hose and is operable, as an alternate discharge, when the faucet is in an on position. Customarily, such sprays are used to access areas of the kitchen sink normally not reachable by the faucet spout discharge. In the past such side sprays, as they are termed in the art, have had a single discharge. The present invention provides a side spray with two different discharge flow patterns. There is a spray pattern in which water flows from a series of uniformly spaced openings about the periphery of the spray head, and there is a stream discharge in which water flows from a central aperture in the spray head.

The spray head is operated by a trigger which has an inoperable or at rest position and two operable positions. When the trigger is first operated, the spray head will provide a stream discharge and if the trigger is depressed further, the discharge will change to a peripheral pattern spray.

Within the body of the spray head there are a stem and a piston. The two are connected together for concurrent movement in response to movement of the trigger. The piston functions in cooperation with a flexible flow diverter, with movement of the piston and stem to the first described position causing water to flow through the piston and past one side of the flexible diverter, with movement of the piston and stem to the second described position causing water to flow from the piston along the opposite side of the flow diverter, through the flow diverter peripherally spaced holes to the spray discharge holes in the spray head. A spring normally urges the piston and stem to a closed position and when the trigger is released will automatically return the spray head to a closed position.

SUMMARY OF THE INVENTION

The present invention relates to side sprays of the type customarily used with kitchen faucets and has particular relation to such a side spray providing alternate stream and spray discharges.

A primary purpose of the invention is a side spray mechanism as described which is simply constructed and reliable in operation.

Another purpose is a side spray in which a readily accessible trigger, mounted on the side spray handle, by movement through successive positions is effective to change the type of discharge of the side spray.

Another purpose is a side spray mechanism as described including a spring biased stem and piston, normally urged to the closed position, but operable to two different open positions to provide for alternate stream and spray discharges.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figures 1, 4, 6:
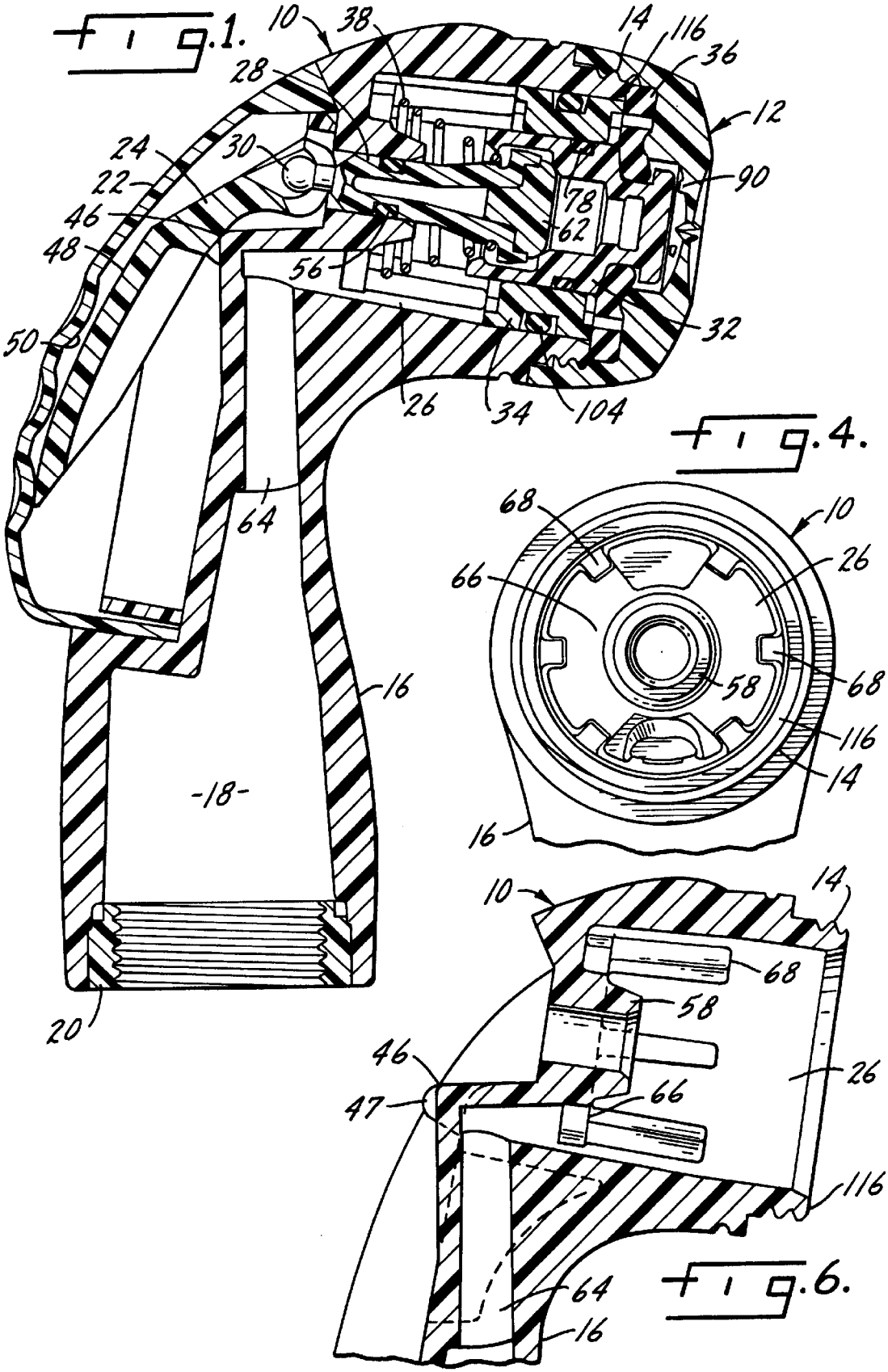
FIG. 1 is an axial section through the spray head of the present invention.
FIG. 4 is a front view of the body, with the operating elements removed.
FIG. 6 is a section along plane 6—6 of FIG. 5.

The basic parts of the side spray are shown in assembled form in FIG. 1 and include a body indicated generally at 10 which has a spray head 12 fastened thereto by fastening means such as threads 14 and a handle 16. The handle provides a water inlet passage 18 and there may be a threaded insert 20 for use in attaching the spray head body to a conventional hose. An operating lever 22 is mounted onto the body 10 and there is a trigger 24 which is responsive to movement of the operating lever to effect operation of the spray head.

Within the body 10 there is a chamber 26 and positioned within the chamber is a stem 28 pivotally attached to the trigger 24, for example, by a ball and socket connection 30. The stem 28 is movable within and is attached for concurrent movement with a piston 32. The piston 32 in turn moves within a port member 34 and functions to cause movement of a diverter 36 to change the water path as received by the spray head. The spray pattern or profile exiting the spray head 12 is directly dependent on the fluid passage within the spray head. The described stem, piston, port member, and diverter are all positioned within the chamber 26, as is a coil spring 38, which urges the stem and piston toward the closed position illustrated in FIG. 1.

The trigger 24 has a socket 40 which forms one portion of the ball and socket joint 30 which connects the stem to the trigger. The trigger has a surface 44 which cooperates with a corner 46 of the body 10 to provide for pivotal movement of the trigger from the closed position of FIG. 1 to the operated positions of FIGS. 2 and 3, as will be described hereinafter. The trigger is limited from side-to-side motion by containing the width of the trigger 42, which is perpendicular to surface 44, within raised surfaces 47 of the body 10. The trigger 24 further has an exterior surface 48 which will be contacted by the interior surface 50 of the operating lever 22 when the spray head is operated. Lever 22 prevents pinching of fingers during operation and also precludes dirt from entering the valve mechanism. It is preferably made of a material which maintains surface friction with wet hands.

Figure 23:
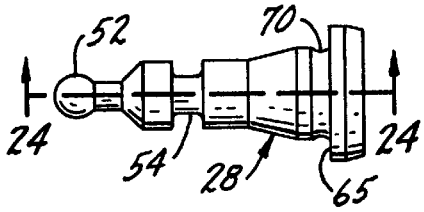
FIG. 23 is a plan view of the stem.
Figure 24:
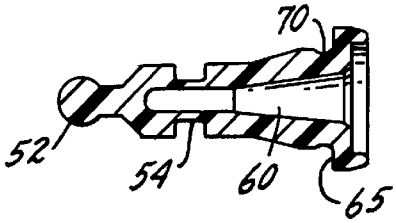
FIG. 24 is a section along plane 24—24 of FIG. 23.

The stem 28 is illustrated in detail in FIGS. 23 and 24 and includes an enlarged head 52 which forms a part of the ball and socket joint 30. There is a groove 54 in the stem which mounts a seal 56, illustrated in FIG. 1, which seals the exterior of the stem to an interior boss 58 formed as a part of the interior body structure. The stem has an open interior 60 and at the end of the stem there is a stem seal 62, which functions in the closed position of FIG. 1, to prevent water from reaching the piston discharge area. The passage of water from the interior chamber 18 is upwardly through a passage 64 in the body and then into chamber 26. The water cannot pass beyond the stem seal 62 until the stem has been moved from the FIG. 1 position. The stem has a shoulder 65 which will cooperate with a portion of the piston, as described hereinafter, so that rearward movement of the stem will result in withdrawal of the piston from the discharge closing position of FIG. 1.

The coil spring 38 bottoms on an annular surface 66 formed in chamber 26 and the spring is surrounded by a plurality of axially extending arms 68 which are effective to both confine the spring and to support the port element 34. The boss 58 which supports the stem is located coaxially with the spring and with the arm 68 and is generally centrally located within the chamber 26, as particularly shown in FIGS. 4 and 6. The outward end of spring 38 is seated within a groove 70 on the stem directly adjacent the shoulder 65, whereby the spring will normally urge the stem 28 to the normally closed position of FIG. 1.

Figures 2, 3, 7, 8, 9:
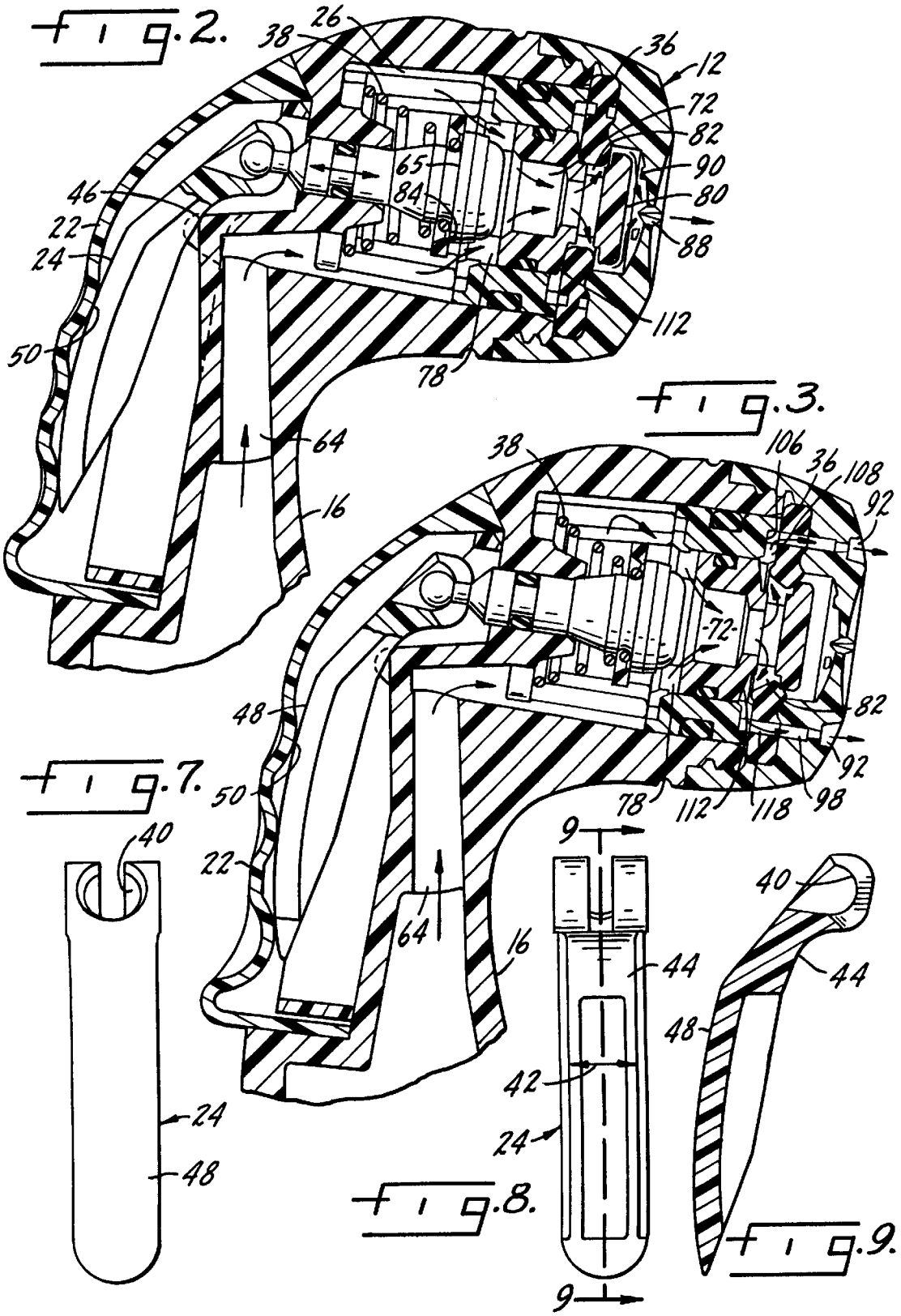
FIG. 2 is an axial section, similar to FIG. 1, but showing the spray head in a stream discharge position.
FIG. 3 is an axial section, similar to FIGS. 1 and 2, but showing the spray head in a spray discharge position.
FIG. 7 is a rear view of the trigger.
FIG. 8 is a front view of the trigger.
FIG. 9 is a section along plane 9—9 of FIG. 8.
Figure 5:
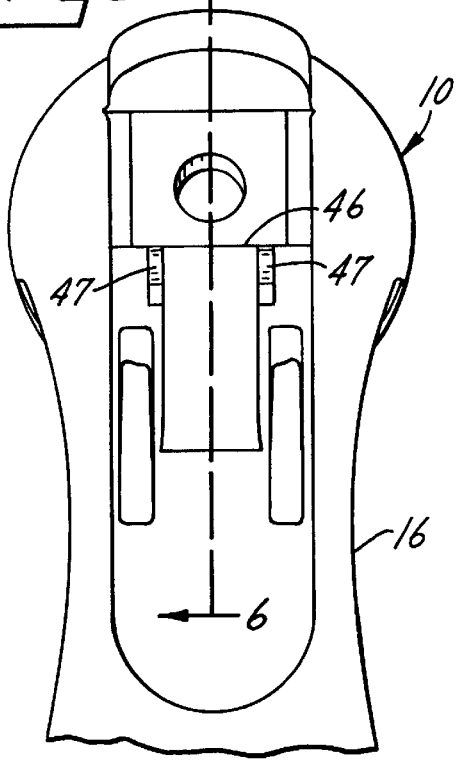
FIG. 5 is a rear view of the body illustrating the handle and trigger mechanism.
Figure 10:
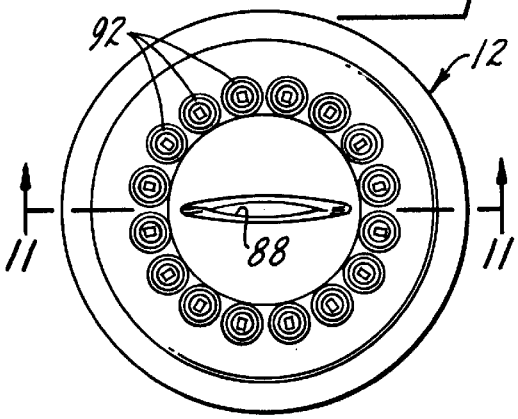
FIG. 10 is a front view of the spray head.
Figure 11:
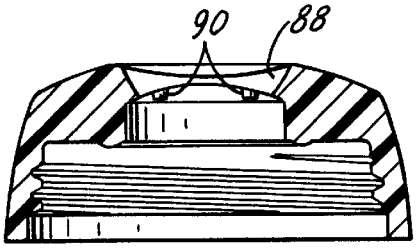
FIG. 11 is a section along plane 11—11 of FIG. 10.

The piston 32 is shown in detail in FIGS. 19 through 22. The stem 28 will be in part positioned within an interior chamber 72 of the piston, with the stem seal 62 of the piston normally closing against a seat 74 within the piston. The piston has an exterior groove 76 within which is positioned a seal ring 78 which seals the exterior of the piston to the interior surface of port member 34. The piston has a plurality of windows 79 which connect the piston exterior to the interior chamber 72. The windows provide a means for passage of water from chamber 26 into the interior of the piston as will be described in connection with the operation of the spray head as shown in FIGS. 2 and 3. The chamber 72 of the piston also has, adjacent its head end 80, a plurality of smaller windows 82 which function as discharge passages so that water may pass from the piston toward the flow diverter 36. The piston has, shown particularly in FIG. 22, an inwardly directed shoulder 84 which cooperates with the shoulder 65 on the stem to provide for concurrent movement of these two elements in response to operation of the trigger.

Figure 13:
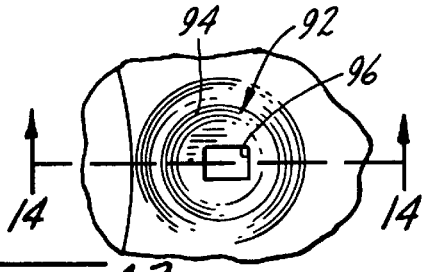
FIG. 13 is a partial enlarged view, from the exterior, illustrating a spray head water passage.
Figure 12:
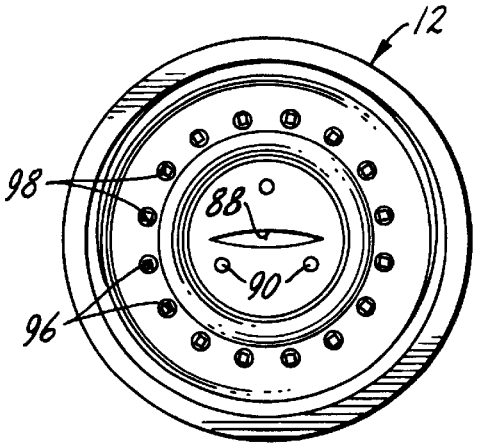
FIG. 12 is a rear view of the spray head.
Figure 14:
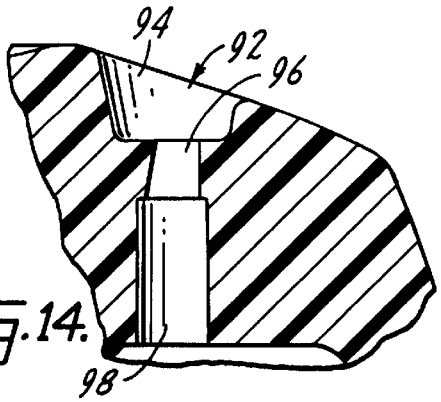
FIG. 14 is a section along plane 14—14 of FIG. 13.

The spray head 12, as indicated above, is threadedly attached to the body 10 and as particularly shown in FIGS. 10 through 14, includes two different types of discharge passages. There is a central stream discharge formed by an aperture 88. Uniformly peripherally spaced about the center of the spray head are a plurality of smaller openings 92 which in combination provide a spray discharge. FIGS. 13 and 14 show the details of the spray openings 92. Each spray opening 92 has an exterior recess 94 connected by a small passage 96 to an axially extending bore 98. The bores 98 open into the chamber 26 directly adjacent the spray former 36 as will be described hereinafter. The spray head 12 also has a plurality of fingers 90 extending toward the piston which space the end of the piston from the inside of the spray head.

Figure 17:
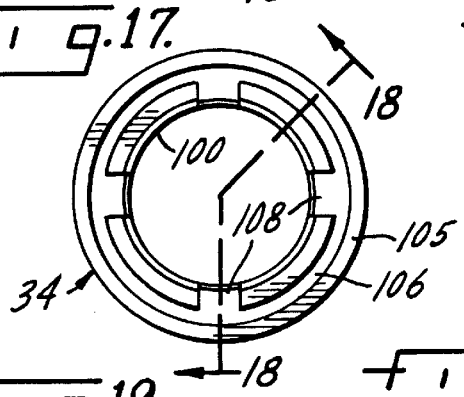
FIG. 17 is a plan view of the port element.
Figure 18:
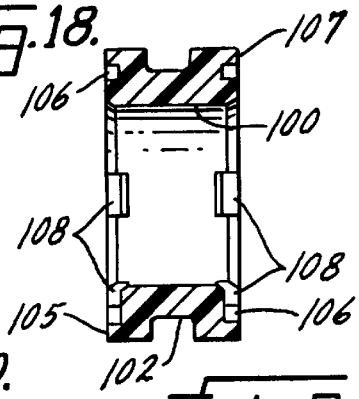
FIG. 18 is a section along plane 18—18 of FIG. 17.
Figure 19:
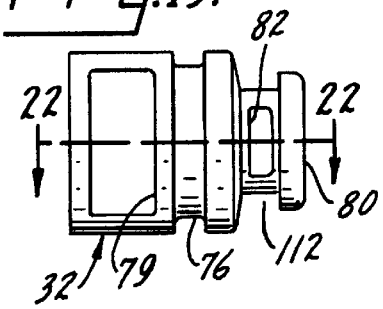
FIG. 19 is a plan view of the piston.
Figure 20:
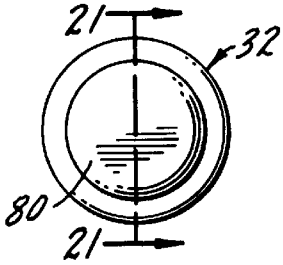
FIG. 20 is a front view of the piston.
Figure 21:
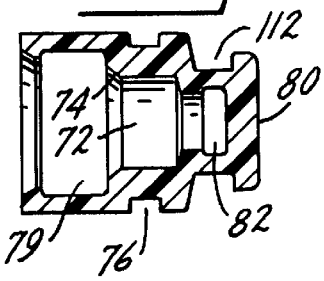
FIG. 21 is a section along plane 21—21 of FIG. 20.
Figure 22:
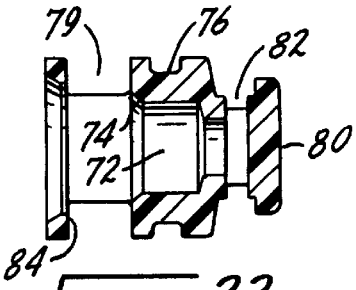
FIG. 22 is a section along plane 22—22 of FIG. 19.

The port member 34 is shown in FIGS. 17 and 18 and may be conveniently formed of plastic, as are most of the elements of the spray head. The port member 34 includes an interior wall 100 which encircles the piston 32 and provides a bearing surface for movement of the piston. The exterior of the port member has a groove 102 within which is positioned a seal ring 104, with the seal ring bearing against the interior of chamber 26 to form a seal therewith. The port member is symmetrical and has side walls 107, each of which has peripherally extending grooves 106 which communicate with radially extending recesses 108. When the port member is assembled in position as shown in FIG. 1, one of the walls 107 will bear against the end of the arms 68, positioning the port member within the chamber 26. The outward wall 105, with its passages 106 and 108, will function to provide a path for water to reach the exterior spray discharge bores 98 after the water has passed through the flow diverter.

Figure 15:
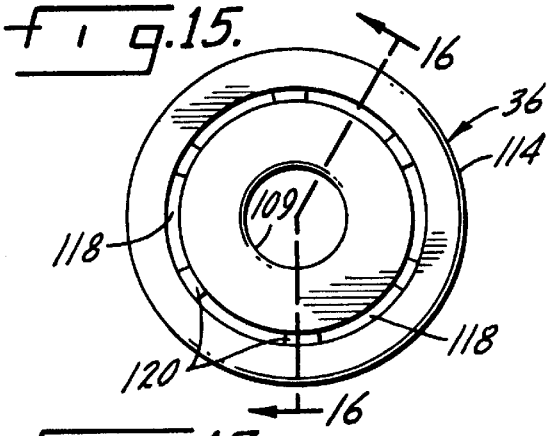
FIG. 15 is a plan view of the flow diverter.
Figure 16:
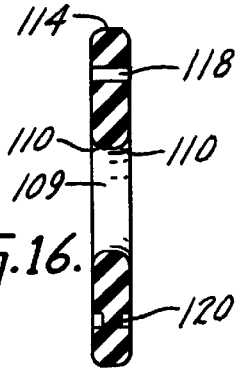
FIG. 16 is a section along plane 16—16 of FIG. 15.

The flow diverter is illustrated in FIGS. 15 and 16 and is preferably formed of a flexible elastomeric or rubberlike material so that the flow diverter may distort in performing its described functions. The flow diverter includes a central passage 109 defined by a curved wall 110, which wall is seated within a groove 112 on the piston 32. This s clearly shown in FIGS. 1, 2 and 3. The outer wall 114 of the flow diverter will be positioned between and will seal against he interior of the spray head 12 and an end wall 116 of the body 10. The flow diverter has a plurality of peripherally disposed and uniformly spaced water passages 118 which, in the spray discharge position, will pass water from the piston through the port member and to the interior of the spray head for discharge through the spray passages 98, 96 and recesses 94. Ribs 120 separate the passages 118. The passages 118 in the flow diverter are coaxially aligned with the bores 98 in the spray head.

The unoperated position of the spray head is shown in FIG. 1. Spring 38 urges stem 28 to a position in which stem seat 62 seals against seat 74 in the interior of the piston. Thus, inflowing water which may be within chamber 26 cannot pass through the piston and reach either of the spray head discharge areas. When operating lever 22 is initially depressed, this will cause pivotal movement of trigger 24 from the closed position of FIG. 1 to the open position of FIG. 2. This movement by the trigger pulls the stem 28 to the left. Initial movement by the stem does not move the piston 32, but once the stem shoulder 65 contacts the piston interior shoulder 84 the piston will be moved away from the spray head. The initial movement of the stem moves the stem seat to open water flow into the interior of the piston. Subsequent movement by the stem pulls the piston 32 to the left to the FIG. 2 position. Water then flows in the direction shown by the arrows. Water flows from chamber 26 into the interior of the piston through windows 79 into the piston interior chamber 72. Water flows out of windows 82 into the space exterior of the piston. The flow diverter has been moved from the sealed position of FIG. 1 to the open position of FIG. 2 in which it is no longer distorted in sealing contact with the spray head. Water will flow out of the windows 82 and on the right-hand side of the flow diverter about the head 80 of the piston and into the area behind the spray head stream discharge port 88. The flow diverter tends to rock within the enlarged groove 112 of the piston when the piston moves. The initial movement to FIG. 2 maintains the seal between the left side of the flow diverter and the right side of groove 112 while opening a passage between the right side of the flow diverter and the left side of groove 112. This permits the water to flow to the spray head spray discharge in the manner illustrated by the arrows of FIG. 2.

Continued movement of the operating lever 22 and the trigger 24 will provide a spray discharge as illustrated in FIG. 3. In this instance, the stem and piston have moved further to the left and now when water flows out of the windows 82 of the piston, it will flow between the left facing side of diverter 36 and the right facing side of groove 112. The flow diverter now seals against the opposite side of groove 112, preventing water from flowing out of the centrally located stream discharge opening 88. In this instance, water flows from the described windows of the piston, outwardly through the radial passages 108 of the port member, along the circumferential passages 106 of the port member, and then outwardly through the passages 118 of the flow diverter, which are in alignment with the peripherally disposed passages 92 of the spray head.

The spray head of the present application provides a simply operable spray device in which by the movement of an operating lever, two different forms of discharge may be provided. The coil spring 38 normally maintains the stem and piston in a closed position, as illustrated in FIG. 1. Movement of the trigger compresses the spring 38 permitting water to flow either out through the central stream discharge of the spray head or outwardly through the peripherally disposed spray passages of the spray head. When the trigger and operating lever are released, the stem and piston return to the closed positions of FIG. 2.

Whereas the preferred form of the invention has been shown and described herein, it should be realized that there may be many modifications, substitutions and alterations thereto.

The embodiments of the invention in which an exclusive property or privilege is claimed are defined as follows:

1. A spray device for use as an alternate water discharge to a faucet, said spray device including a body having a handle and a spray head, said spray head having first water discharge means and second water discharge means, a trigger movable on said body between an inoperable position, a first operable position, and a second operable position, a chamber within said body communicating with said first and second discharge means, a water passage in said handle communicating with said chamber, a piston movable within said chamber, a water passage within said piston connectable to said handle water passage, a stem within said chamber and connected to said trigger for concurrent movement therewith, said stem including a seal for closing said piston water passage from said handle water passage, spring means biasing said stem seal toward a piston water passage closing position, said stem and piston having interconnecting means thereon providing concurrent movement thereof, a flow diverter adjacent said first and second water discharge means, said flow diverter being movable by said piston between positions in which water flows from said piston water passage to either said first or second water discharge means, operation of said trigger from an inoperable position to said first operable position moving said stem seal to open the piston water passage and moving said piston and flow diverter to direct water through said first discharge means, movement of said trigger to said second operable position causing said piston to move said flow diverter to a position to direct water through said second discharge means.

2. The spray device of claim 1 wherein said second water discharge means is peripherally disposed about said first water discharge means.

3. The spray device of claim 1 wherein said stem is movable relative to said piston.

4. The spray device of claim 1 wherein said stem and piston move along the same coaxial path in response to movement of said trigger, said spring means being coaxial with said stem and piston path.

5. The spray device of claim 4 wherein said stem extends at least in part within said piston.

6. The spray device of claim 5 wherein said piston water passage is in part coaxial with the path of movement of said piston.

7. The spray device of claim 5 wherein said stem and piston interconnecting means includes an outward extension on said stem and an inward extension on said piston.

8. The spray device of claim 7 wherein said spring means is seated on said body and is in contact with said stem.

9. The spray device of claim 8 wherein said spring means contacts said stem adjacent said stem extension.

10. The spray device of claim 5 wherein said piston water passage is in part radial.

11. The spray device of claim 4 wherein said flow diverter is coaxial with said piston and located radially outside of said piston.

12. The spray device of claim 11 wherein said flow diverter is flexible.

13. The spray device of claim 12 wherein said piston includes a peripheral groove, said flow diverter being positioned in part within said piston peripheral groove.

14. The spray device of claim 13 wherein the exterior of said flow diverter is fixed in said body.

15. The spray device of claim 14 wherein the interior of said flow diverter is movable within said piston groove.

16. The spray device of claim 15 wherein water passes from said piston water passage along one side of said flow diverter when said trigger is in said first operable position and passes from said piston water passage along the opposite side of said flow diverter when said trigger is in said second operable position.

17. The spray device of claim 16 wherein said flow diverter has an interior central water passage adjacent said piston peripheral groove and said flow diverter has an exterior series of generally uniform spaced passages radially outside of said flow diverter central passage.

18. The spray device of claim 17 wherein said flow diverter central passage communicates with said spray head first water discharge means and said flow diverter series of peripheral uniformly spaced passages communicates with said spray head second water discharge means.

19. The spray device of claim 1 wherein said trigger is pivotally attached to an end of said stem.

20. The spray device of claim 19 wherein said trigger pivots about a portion of said body when moving between said described positions.

* * * * *